US012054677B2

(12) United States Patent
Schenk et al.

(10) Patent No.: US 12,054,677 B2
(45) Date of Patent: Aug. 6, 2024

(54) PROCESS FOR THE PREPARATION OF LOW MOLECULAR WEIGHT AROMATIC COMPOUNDS SUCH AS BENZENE, TOLUENE, AND XYLENES (BTX) FROM PLASTICS

(71) Applicant: BioBTX B.V., Groningen (NL)

(72) Inventors: Niels Jan Schenk, Groningen (NL); André Heeres, Groningen (NL); Inouk Kruize-Muizebelt, Groningen (NL)

(73) Assignee: BioBTX B.V., Groningen (NL)

( * ) Notice: Subject to any disclaimer, the term of this patent is extended or adjusted under 35 U.S.C. 154(b) by 269 days.

(21) Appl. No.: 17/598,551

(22) PCT Filed: Mar. 27, 2020

(86) PCT No.: PCT/NL2020/050212
§ 371 (c)(1),
(2) Date: Sep. 27, 2021

(87) PCT Pub. No.: WO2020/204707
PCT Pub. Date: Oct. 8, 2020

(65) Prior Publication Data

US 2022/0195310 A1 Jun. 23, 2022

Related U.S. Application Data

(60) Provisional application No. 62/826,815, filed on Mar. 29, 2019.

(30) Foreign Application Priority Data

May 28, 2019 (EP) ..... 19176932

(51) Int. Cl.
*C10G 1/10* (2006.01)
*C10B 49/10* (2006.01)
(Continued)

(52) U.S. Cl.
CPC ..... *C10G 1/10* (2013.01); *C10B 49/10* (2013.01); *C10B 49/22* (2013.01); *C10B 53/07* (2013.01); *C10G 1/08* (2013.01)

(58) Field of Classification Search
None
See application file for complete search history.

(56) References Cited

U.S. PATENT DOCUMENTS 5,504,259 A * 4/1996 Diebold ..... C10G 1/002 585/242
9,169,442 B2 * 10/2015 Huber ..... C10G 1/002
(Continued)

FOREIGN PATENT DOCUMENTS

JP 2016-514170 A 5/2016
WO 2009064321 A3 5/2009
WO 2015047085 A1 4/2015

OTHER PUBLICATIONS

Heeres et al., "BioBTX aims for production of aromatics by catalytic pyrolysis of biomass and plastic waste", IEA Bioenergy Task 34 Newsletter, PYNE Issue 34, Jan. 1, 2014 (Jan. 1, 2014), pp. 13-14, XP055159953.
(Continued)

*Primary Examiner* — Tam M Nguyen
(74) *Attorney, Agent, or Firm* — Verrill Dana, LLP

(57) ABSTRACT

The present invention relates to a novel process for the preparation of low molecular weight aromatic compounds such as benzene, toluene, and xylenes (BTX) from plastics. Provided is a thermo-catalytic pyrolysis process for the preparation of aromatic compounds from a feed stream comprising plastic, comprising the steps of: a) subjecting a feed stream comprising a plastic to a pyrolysis treatment at a pyrolysis temperature in the range of 600-1000° C. to produce pyrolysis vapors; b) optionally cooling the pyrolysis vapors to a temperature that is below the pyrolysis
(Continued)

Figure 1:
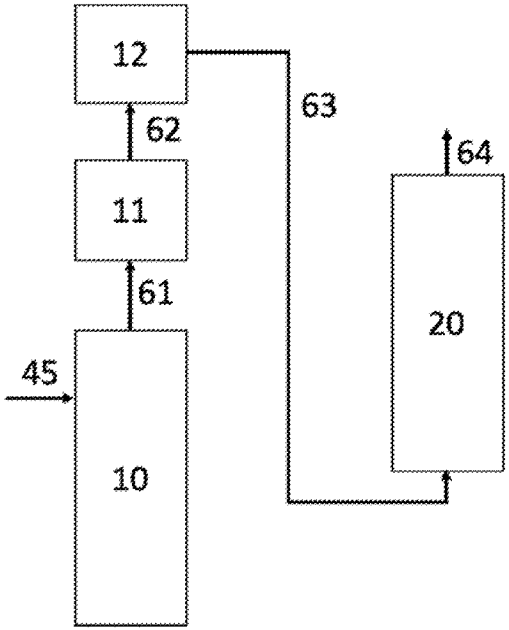

temperature; e) contacting the vaporous phase with an aromatization catalyst at an aromatization temperature in the range of 450 700° C., which aromatization temperature is at least 50° C. lower than the pyrolysis temperature, in a catalytic conversion step to yield a conversion product comprising aromatic compounds; and d) optionally recovering the aromatic compounds from the conversion product.

19 Claims, 5 Drawing Sheets

(51) Int. Cl.

| | |
|---|---|
| ***C10B 49/22*** | (2006.01) |
| ***C10B 53/07*** | (2006.01) |
| ***C10G 1/08*** | (2006.01) |
| ***C10G 9/24*** | (2006.01) |

(56) References Cited

U.S. PATENT DOCUMENTS

| | | | | |
|---|---|---|---|---|
| 2009/0170739 | A1 | 7/2009 | Miller | |
| 2012/0310023 | A1* | 12/2012 | Huang | C10G 1/002 585/241 |
| 2014/0107306 | A1* | 4/2014 | Mazanec | C07C 5/10 562/487 |
| 2017/0247617 | A1 | 8/2017 | Schenk et al. | |
| 2019/0367428 | A1* | 12/2019 | Ramamurthy | C07C 4/06 |
| 2020/0017773 | A1* | 1/2020 | Ramamurthy | B01J 6/008 |
| 2022/0290053 | A1* | 9/2022 | Mleczko | C10B 53/07 |
| 2022/0340819 | A1* | 10/2022 | Gray | C10B 47/24 |

OTHER PUBLICATIONS

Sporty et al., "Immunomagnetic Separation and Quantification of Butyrylcholinesterase Nerve Agent Adducts in Human Serum", Analytical Chemistry, American Chemical Society, ISSN 003-2700, 2010, vol. 82, Nr: 15, pp. 6593-6600.

Sun et al., "Development of MALDI-TOF-MS Method to Identify and Quantify Butyrylcholinestera Inhibition Resulting from Exposure to Organophosphate and Carbamate Pesticides", Journal of the American Society for Mass Spectrometry, 2007, 20070324 Elsevier Science Inc, US-ISSN-1044-0305, vol. 18, Nr:4, pp. 698-706.

Wang et al., "Enzyme-linked immunosorbent assay for detection of organophosphorylated butylcholinesterase: A biomarker of exposure to organophosphate agents", Analytica Chimica Acta 2011, vol. 693, pp. 1-6 (year 2011).

Office Action of Japan application 2021-560331 Ref. No. F83500A1 Mailing No. 669780 Mailing Date: Jan. 9, 2024.

* cited by examiner

PROCESS FOR THE PREPARATION OF LOW MOLECULAR WEIGHT AROMATIC COMPOUNDS SUCH AS BENZENE, TOLUENE, AND XYLENES (BTX) FROM PLASTICS

The present invention relates to a novel process for the preparation of low molecular weight monocyclic aromatic compounds such as benzene, toluene, and xylenes (BTX) from plastics. These compounds are important starting materials for high volume chemicals such as ethylbenzene, cumene, cyclohexane, adipic acid (from benzene), toluene diisocyanate, benzaldehyde and benzoic acid (from toluene) and terephthalic acid (from p-xylene).

Currently, the above-described aromatic compounds are mainly produced via refinery processes of fossil resources. Common processes include steam cracking, steam reforming, catalytic cracking and catalytic reforming. Alternatively, biomass, waste or a combination thereof is used for preparation. Mixed waste plastics are considered to be an alternative feedstock of interest for this purpose. Several routes have been proposed which can convert biomass or waste plastics materials via chemical synthesis and/or thermochemical conversion to aromatics. However, only a few technologies have been scaled-up to a pilot scale or beyond.

The thermal conversion of plastics towards aromatics is a promising technique to reduce the plastic disposal and produce high-volume chemicals, especially for mixed and/or contaminated plastics that cannot be easily recycled. Whereas currently these streams are being incinerated and, in some cases, used for the conversion of plastics into alternative fuels, a conversion towards chemical building blocks for the chemical industry would significantly add value to these waste streams.

Various articles and patents describe the (catalytic) pyrolysis of plastics, mixed plastic waste, plastics mixed with biomass, and mixtures thereof towards alternative fuels and high-volume chemicals. A distinction can be made between five types of conversion:

1. Non-catalytic pyrolysis: the non-catalytic thermal decomposition of materials at elevated temperatures in an inert atmosphere. Pyrolysis involves the change of chemical composition and is irreversible.
2. In situ catalytic pyrolysis: pyrolysis, as described above, in the direct presence of a catalyst. The catalyst may alter the required pyrolysis temperature, the product composition, or both.
3. Ex situ catalytic pyrolysis: pyrolysis as described above, where the vapours from the pyrolysis reaction are upgraded using a catalyst in a section that is distinguishable from the pyrolysis section,
4. Integrated Cascading Catalytic Pyrolysis (ICCP): a combination of #2 and #3, i.e. catalytic pyrolysis, typically with a cracking catalyst, followed by vapour upgrading with a second catalyst.
5. Two-step non-integrated processes: pyrolysis, with or without the aid of a cracking catalyst, followed by condensation, and subsequently catalytic conversion of at least a fraction of the liquids.

Lopez et al. (Renewable and Sustainable Energy Reviews, 73 (2017), pp. 346-368) reviews the literature on thermal conversion of plastics towards fuels and chemicals. Miandad et al. (Process Safety and Environmental Protection, 102 (2016), pp. 822-838 reviews the literature on the Catalytic Pyrolysis of Plastic Waste.

Various studies were directed at the production of BTX from waste plastics by thermal or catalytic pyrolysis, using a selection of operating conditions such as temperature, heating rate, residence time, catalysts. See for example Bagri and Williams (Journal of Analytical and Applied Pyrolysis, 63, 1 (2002), pp. 29-41), who studied temperature effects in an ex situ catalytic pyrolysis process of polyethylene. Pyrolysis was performed at 500° C. and the pyrolysis gases were passed to a second reactor containing a catalyst bed at a temperature in the range of 400–600° C. It was found that the aromatic content increased with increasing the temperature of catalytic conversion.

Takuma et al, studied the production of aromatic hydrocarbons by catalytic degradation of polyolefins with H-gallosilicate catalyst at 375-550° C. It was found that the BTX yield was dependent on the temperature and a 60.5% BTX yield could be obtained at 525° C. However, since the H-gallosilicate catalyst cannot be prepared in an economically feasible fashion, this process does not allow for application at an industrial scale. At any rate, the overall conclusion in Lopez et al. is that the BTX yields reported, using industrially scalable methods, are low, usually below 20%.

The present inventors therefore aimed at increasing the yields of low molecular weight aromatics, in particular monocyclic aromatics such as BTX, from a feed stream comprising plastics in a process that allows for scaling up commercial production of BTX, in particular a process that involves the use of a catalyst that is or can be made commercially available.

It was surprisingly observed that unprecedented high yields of BTX can be obtained if the pyrolysis temperature in an ex situ pyrolysis of plastics is increased significantly above the conventional pyrolysis temperature, i.e. in the range of 600-1000° C., followed by cooling of the pyrolysis vapours and subjecting the vapours to a catalytic aromatization step at a temperature in the range of 450–700° C., provided that the aromatization temperature is significantly lower than the pyrolysis temperature. For example, subjecting a feed stream comprising (mixed) plastics to pyrolysis at 800° C. followed by catalytic aromatization at 550° C. yielded a product stream comprising more than 40 wt % BTX.

Accordingly, the invention provides an ex situ catalytic pyrolysis or ICCP process for the preparation of low molecular weight monocyclic aromatic compounds from a feed stream comprising plastic, comprising the steps of:

a) subjecting a feed stream comprising a plastic to a pyrolysis treatment at a pyrolysis temperature ($T_{pyr}$) in the range of 600-1000° C. to produce pyrolysis vapors;
b) optionally cooling the pyrolysis vapors to a temperature that is below the pyrolysis temperature; and
c) contacting the (cooled) pyrolysis vapors obtained in a) or h) with an aromatization catalyst at an aromatization temperature ($T_{arom}$) in the range of 450-700° C., which $T_{arom}$ is at least 50° C. lower than $T_{pyr}$, in a catalytic conversion step to yield a conversion product comprising low molecular weight aromatic compounds.
d) optionally recovering the low molecular weight monocyclic aromatic compounds from the conversion product.

An ex-situ catalytic pyrolysis process of the present invention is not disclosed or suggested in the art. The "optimal" pyrolysis temperature ($T_{pyr}$) for non-catalytic pyrolysis of plastics is generally considered to be about 500° C. At this temperature, the highest yield of condensable liquids (oils) is obtained. A lower $T_{pyr}$ gives more coke production while a higher $T_{pyr}$ produces more gasses. The choice for $T_{pyr}$ that produced the highest oil yield is therefore the obvious choice. It is generally assumed that 500° C.

is also the optimal $T_{pyr}$ for ex-situ catalytic pyrolysis of plastics Studies aimed at optimizing the yield of a certain product of interest, e.g. BTX, typically focuses on the second stage wherein catalytic conversion takes place. Indeed, the effect of variations in the aromatization temperature $T_{arom}$ has been the subject of various studies. For example, the study of Bagri et al. performs pyrolysis of plastics at 550° C., and teaches that increasing the temperature for catalytic aromatization from 400 to 600° C. can enhance BTX formation. No mention is made about modifying (increasing) the pyrolysis temperature. Furthermore, for practical reasons, a process wherein $T_{pyr}$ and $T_{arom}$ are the same is often utilized in ex situ pyrolysis Since the optimal $T_{arom}$ is in the range of the presumed optimal $T_{pyr}$, there was no incentive in the art to separately investigate the effect of varying $T_{pyr}$.

US2017/0247617 in the name of the application teaches a broad range of 300-1000° C. for both $T_{pyr}$ and $T_{arom}$ in a ICCP/two step process for producing BTX from a biomass feed stream, which may contain (waste) plastics. Importantly, nothing is mentioned about selecting a $T_{pyr}$ in the currently claimed range which is at least 50° C. above $T_{arom}$. In contrast, and in line with the generally held view in the prior art, the examples are all performed in the conventional range of 500–550° C., and $T_{pyr}$ and $T_{arom}$ being (almost) identical (540/550° C. and 500/500° C.).

US2009/0170739 discloses a process involving pyrolysis of waste plastics for preparing a pour point depressing lubricant base oil component. Pyrolysis is performed in the range of 450 to 700° C. with a pyrolysis residence time of 3 to 60 minutes to produce a pyrolysis effluent which is then contacted with an isomerization dewaxing catalyst, generally at a temperature from about 200° C. to about 475° C. In contrast to the present invention, US2009/0170739 does not use an aromatization catalyst and does not yield a conversion product comprising low molecular weight monocyclic aromatics.

In one embodiment of the present invention, $T_{pyr}$ is in the range of 700 to 1000° C., preferably 700 to 950° C. For example, pyrolysis is performed at 720, 740, 750, 760, 780, 800, 825, 850, 875, 900, 925, 950, 975 or 1000° C. In one aspect, $T_{pyr}$ is in the range of 750 to 950° C., e.g. 800 to 950° C., 850 to 950° C., 750 to 900° C., 750 to 875° C., 750 to 850° C., 750 to 825° C., 750 to 800° C.

The pyrolysis reaction according to the invention is typically a fast process, with a residence time of only several minutes, e.g. up to 3 minutes. In one embodiment, the residence time in the pyrolysis reactor is in the range of 0.1 seconds to 3 minutes, preferably 1 second to 2 minutes, such as 1, 3, 5, 7, 10, 15, 20 25, 30, 45, 60, 80, 90 or 100 seconds. The pyrolysis reaction at the relatively high $T_{pyr}$ as herein disclosed produces pyrolysis vapors comprising low molecular weight alkanes and alkenes, which are subsequently converted at $T_{arom}$ with the aid of an aromatization catalyst to low molecular weight monocyclic aromatics, in particular benzene, toluene and/or xylene.

Typically, the aromatization reaction according to the invention is also a fast process, with a residence time of only several minutes, e.g. up to 3 minutes. In one embodiment, the residence time in the aromatization zone in the range of 0.1 seconds to 3 minutes, preferably 0.5 seconds to 2 minutes, more preferably less than 30 seconds. Exemplary residence times are 1, 3, 5, 7, 10, 15, 20 25, 30, 45, 60, 80, 90, 100 or 120 seconds.

According to the invention, $T_{arom}$ is at least 50° C. below $T_{pyr}$ and in the range of 450 to 700° C. For example, $T_{arom}$ is at least 80° C., preferably at least 100° C., more preferably at least 150° C. lower. For example, it is at least 80, 100, 150, 200, 225, 250, 275, 300 or 350° C. lower. The maximal difference between $T_{pyr}$ and $T_{arom}$ ($\Delta T_{pyr}T_{arom}$) in a two-stage process of the invention can vary, but will typically be up to about 250° C.

Interestingly however, the proportion of xylenes in a BTX conversion product obtained from e.g. a polypropylene stream was found to be optimal when $\Delta T_{pyr}-T_{arom}$ was at least 50° C. but not more than about 200° C. Xylenes are typically the most desired compounds comprised in a BTX product. Accordingly, in one embodiment the invention provides a two-step thereto-catalytic pyrolysis process for the preparation of low molecular weight monocyclic aromatic compounds, in particular xylene, from a feed stream comprising plastic, preferably polypropylene, comprising the steps of:

a) subjecting a feed stream comprising a plastic to a pyrolysis treatment at a pyrolysis temperature in the range of 600–1000° C., preferably for a duration of up to 2 minutes, to produce pyrolysis vapors comprising low molecular weight alkanes and alkenes;
b) optionally actively cooling the pyrolysis vapors to a temperature that is below the pyrolysis temperature; and
c) contacting the pyrolysis vaporous phase with an aromatization catalyst at an aromatization temperature in the range of 450-700° C., preferably 500-650° C., which aromatization temperature is 50° C. to 200° C., preferably 50 to 150° C., lower than the pyrolysis temperature, in a catalytic conversion step to yield a conversion product comprising low molecular weight (monocyclic) aromatic compounds; and
d) optionally recovering the low molecular weight monocyclic aromatic compounds, preferably xylene, from the conversion product.

In one embodiment, $T_{arom}$ in a process provided herein is in the range of 450 to 650° C. For example, aromatization is performed at 450, 480, 500, 525, 550, 575, 600, 625, 650, 675 or 700. Exemplary $T_{arom}$ ranges include 450 to 650° C., 500 to 700° C., 450 to 600° C., 550 to 650° C., 500 to 600° C., 450 to 550° C., 500 to 550° C., 550 to 600° C., 600 to 700 and 550 to 700° C. In one preferred aspect, $T_{arom}$ is 450 to 550° C., such as 500 to 550° C.

Besides BTX yields and xylenes yields in particular, keeping $T_{arom}$ sufficiently low has additional technological benefits, especially when the aromatization catalyst is a zeolite catalyst. Zeolite catalysts are prone to damage and resulting deactivation at higher temperatures. Therefore, the process with the temperature conditions of the present invention are beneficial for the catalyst lifetime and for the economics of the process.

Furthermore, a process of the invention allowing for high BTX yields, while keeping the $T_{arom}$ relatively low, i.e. up to 600° C., allows for the use of lower quality steel. This has a significant impact on the capital costs of the installation and therefore for the economics of the process.

As will be understood by a person skilled in the art, any exemplary and preferred temperature value or range for $T_{pyr}$ can be combined with any exemplary and preferred temperature value or range for $T_{arom}$.

In a specific aspect, the invention provides an ex situ catalytic pyrolysis process for the preparation of low molecular weight monocyclic aromatic compounds from a feed stream comprising plastic, comprising the steps of:

a) subjecting a feed stream comprising a plastic to a pyrolysis treatment at a $T_{pyr}$ in the range of 650-850° C., preferably 700-750° C., to produce pyrolysis vapors;

b) optionally cooling the pyrolysis vapors to a temperature that is below $T_{pyr}$, and c) contacting the (cooled) pyrolysis vapors obtained in a) or b) with an aromatization catalyst at a $T_{arom}$ in the range of 500-600° C., in a catalytic conversion step to yield a conversion product comprising low molecular weight monocyclic aromatic compounds.

A method of the invention allows for producing valuable chemicals from waste plastic, such as post-consumer waste plastic, off spec plastic, industrial scrap plastic and the like. The waste plastic can be a single plastic or, preferably, a mixed waste plastic. The feed stream may contain heteroatoms such as oxygen, sulfur and nitrogen, but also halogens such as chlorine and bromine. Especially for (mixed) plastics that do not contain aromatic moieties within the polymeric framework (polyethylene, polypropylene, etc.) the effect of increasing the temperature in the first pyrolysis step significantly increased the yield of BTX. A process of the invention can convert a plastic feed stream to a conversion product that comprise a significant fraction of lower molecular weight aromatics, preferably wherein said lower molecular weight aromatics are benzene, toluene, and xylenes (BTX). For example, conversion products comprising at least 25 wt %, preferably at least 30 wt %, more preferably at least 35 wt % BTX can be obtained.

The feed stream may comprises synthetic or semi-synthetic polymers or mixtures thereof, including polyolefines, aromatic polymers, fibre enforced composite materials, multi layered plastics, mixed plastics waste polyamides, and/or recycling refuses, or a liquid stream derived from the pyrolysis of any of the preceding materials. The feed stream may be pre-treated, for example the pre-treatment of the feed consists of liquefaction, solvation or slurrification of the feed stream. In some embodiments the feed stream may contain other organic streams such as for example biomass or pyrolysis oil.

A plastic is mostly constituted of a particular polymer and the plastic is generally named by this particular polymer. Preferably, a plastic contains more than 25% by weight of its total weight of the particular polymer, preferably more than 40% by weight and more preferably more than 50% by weight. Other components in plastic are for example additives, such as fillers, reinforcers, processing aids, plasticizers, pigments, light stabilizers, lubricants, impact modifiers, antistatic agents, inks, antioxidants, etc. Generally, a plastic comprises more than one additive. Plastics suitable in the process of the present invention are for example polyolefins and polystyrene, polypropylene and polystyrene. wherein the feed stream comprises or consists of one or more of polypropylene (PP), polyethylene (PE), including high density polyethylene (HDPE) and low density polyethylene (LDPE), Polybutylene terephthalate (PBT) and Polyethylene terephthalate (PET), acrylonitrile butadiene styrene (ABS), polystyrene (PS), MPB and Styrofoam FB, and any mixture thereof. Mixed plastics mostly constituted of polyolefin and polystyrene are also encompassed. The polymer may be in the form of a composite material, such as metallized plastic bag (MPB), fiber-reinforced polymer, multi-layer plastic, hybrid material, or other.

The pyrolysis treatment of step a) may be carried out with the use of an inert heat transfer medium, a cracking catalyst, an acid eliminating material, or a combination thereof.

In one embodiment, the pyrolysis treatment step a) is performed in the presence of a cracking catalyst to yield a vaporous fraction and a coke-laden cracking catalyst, followed by separating the vaporous fraction from the coke-laden cracking catalyst prior to contacting the vaporous phase with the aromatization catalyst. Preferably, the coke-laden cracking catalyst is regenerated by contacting the coke-laden cracking catalyst with oxygen to yield a regenerated cracking catalyst. More preferably, the regenerated cracking catalyst, is recycled to the pyrolysis treatment of step a).

A suitable cracking catalyst positively influences the pyrolysis of the feed stock thereby increasing the amount of vapours formed and/or changing the composition of the vaporous phase such that higher yields of aromatics are being formed. Such inert material includes, for example hut without limitation, different types of sand, pumice and silicon carbide.

The cracking catalyst is preferably selected from acidic or alkaline inorganic materials and combinations thereof. Alkaline refractory oxides include magnesium oxide, calcium oxides, chromium oxides and combinations thereof, which therefore constitute suitable cracking catalysts. Suitable acidic refractory oxides include silica-alumina, zeolites, alumina, silica, or combinations thereof, Red mud, etc, $Co/Al_2O_3$, $Mn/Al_2O_3$, kaolin, Hydrocalcite. In some embodiments, the catalyst may include comprise a metal and/or a metal oxide. Suitable metals and/or oxides include, for example, nickel, platinum, vanadium, palladium, manganese, cobalt, zinc, copper, chromium, gallium, sodium, bismuth, tungsten, zirconium and/or any of their oxides, among others.

The heat transfer medium/cracking catalyst may also include compounds that can remove acid compounds like hydrochloric acid originating from e.g. PVC, such as iron chloride, calcium carbonate, calcium oxide, calcium hydroxide, and crushed oyster shells and other alkaline components.

Since in a method of the invention, step e) is performed at a lower temperature than step a), it is inherent that the pyrolysis vapours obtained in step a) are passively cooled in step c). However, it is preferred that an active cooling step b) is performed prior to contacting the pyrolysis vapours to the catalytic conversion step In one embodiment, the pyrolysis step a) and the catalytic conversion step c) take place in two different reactors. However, it is also encompassed to use one single reactor comprising different reactor zones, each zone operating at a distinct temperature and having different (catalytic) bed. See for example US2013/261355.

The pyrolysis treatment of step a) may be carried out in a variety of reactors. Such reactors include, without limitation, a rotary kiln, continuous stirred tank reactor (CSTR), a fixed bed reactor, a moving bed reactor, an auger reactor, a screw conveyor reactor, an entrained flow reactor, a rotating cone reactor, a fluidized bed reactor, a spouted bed reactor, and circulating fluidized bed reactor.

Reactors that allow for a relatively short contact time and for intense mixing of the components of the feed stream are most preferred, Since this is the case for a fluidized bed reactor, these reactors are particularly preferred. However, reactors that allow for a relatively long reaction time may be preferred when the feedstock particle size does not allow short contact time, for example in the case of composite waste.

The pyrolysis reactor may contain a heat carrier. In one embodiment, the pyrolysis reactor contains a substance able to remove acid compounds like hydrochloric acid, such as iron chloride, calcium carbonate, calcium oxide, calcium hydroxide, and crushed oyster shells and other alkaline components.

The stream comprising pyrolysis products may be subjected to a separation step to remove non-vapours. The separation of the vaporous fraction from the non-vaporous coke fraction may be carried out in a separation system by any known method to separate a vapour from a solid anchor liquid. The vapours may be subjected to a cooling system in order to reduce the temperature of the vapours. The cooling system may be for example, uninsulated piping, an air-cooled heat exchanger, or a liquid-cooled heat exchanger.

The vaporous fraction thus obtained is subsequently used for the conversion into aromatic compounds.

In some embodiments, the pyrolysis reactor is equipped with a system to treat non-vaporous materials. Treatments may include coke removal by oxidation, removal of particles with certain size, removal of particles with a certain density, removal of aerosols, or a combination thereof. When the material involves a catalyst, the treatment may include regeneration or re-activation of the catalyst.

The vaporous fraction obtained by pyrolysis according to the invention is very suitable for conversion to aromatics, since it tends to comprise saturated and unsaturated (low molecular weight) hydrocarbons that are readily converted into aromatic compounds in step c) of a method of the invention using the appropriate conditions.

Step c) comprises contacting the (cooled) pyrolysis vapors obtained in a) or b) with an aromatization catalyst at an aromatization temperature ($T_{arom}$) in the range of 450-700° C., which $T_{arom}$ is at least 50° C. lower than $T_{pyr}$, in a catalytic conversion step to yield a conversion product comprising aromatic compounds. At these temperatures, aromatization tends to increase and the formation of low molecular weight monocyclic aromatic compounds from the vaporous phase is most optimal. The pressure suitably ranges from 1 to 4 bar.

As in the case of the pyrolysis treatment of step a), also the conversion treatment of step c) of the present invention may be carried out in a variety of reactors. The aromatization treatment of step c) is suitably carried out in a fixed bed, a moving bed or a fluidized bed. The two reactors can, but do not need to be integrated.

The aromatization catalyst may comprise one or more of a zeolite catalyst, a non-zeolite catalyst, a metal catalyst and/or a metal oxide catalyst. In a specific aspect, the aromatization catalyst is a zeolite catalyst, suitably selected from aluminosilicates, SAPOs, silicates and combinations thereof. It has been found that the aromatization catalyst preferably is acidic. The acidity may be influenced by the structure of the aluminosilicate and also by the ratio between silicate moieties and alumniate moieties in the aluminosilicate. The acidity may e.g. be accomplished by ion exchange of the, aromatization catalyst with ammonium salts and subsequent calcination thereof. For N-containing feeds, basic catalysts might be preferred. Suitable silica-alumina ratios include those in the range of 5 to 100, preferably, from 10 to 80, more preferably from 20 to 60. Another feature that may play a role in the performance of the present catalyst is the pore diameter. It has been found that particularly good results are obtained if the pore diameter of the aromatization catalysts is in the range of 4.5 to 6.5 Å, preferably from 5 to 6 Å.

The zeolite catalyst, is preferably selected from the group consisting of (S)AlPO-31, EU-1, ferrierite, IM-5, MCM-22, modernite, SSZ-20, SSZ-23, SSZ-55, SUZ-4, TNU-9, zeolite A, zeolite beta, zeolite X, zeolite Y, ZSM-11, ZSM-23, ZSM-35, ZSM-5, ZSM-57 and combinations thereof and can also be treated, exchanged, or impregnated with metals in order to improve the yield of aromatics. In a specific aspect, the aromatization catalyst is ZSM-5.

Metals could be chosen from nickel, platinum, vanadium, palladium, manganese, cobalt, zinc, copper, chromium, gallium, sodium, bismuth, tungsten, zirconium, indium, tin, thallium, lead, molybdenum, and/or any of their oxides, among others.

The zeolite may be comprised in an amorphous binder, Thus, the catalyst may suitably comprise an amorphous binder in addition to a zeolite. The amorphous binder gives the particle thus obtained strength, density, shape, and provides a certain particle size to the catalyst particles. Therefore, the amorphous binder can suitably be selected from inorganic refractory oxides, in particular alumina, silica, silica-alumina, titania, zirconia, clays, layered mixed-metal oxides, phosphates, sulphonates and mixtures thereof.

When a binder is used, the amount of the binder in such combinations may vary within wide ranges. Suitably the amount of amorphous binder in a zeolitic second catalyst is in the range of 30 to 80% wt, preferably, 40 to 70% wt, based on the weight of the zeolite and the amorphous binder. Such a ratio not only provides a particle with a satisfactory mechanical strength, but is also, in the case of silica-alumina, provide the synergistic effect of an increased aromatic compound yield, compared to the proportionally expected yield. In a process according to the invention, the aromatization catalyst may be regenerated by contacting the coke-loaden catalyst with oxygen to yield a regenerated aromatization catalyst.

Suitably, the present, process is carried out as a continuous process. Thus, the step c) of the present process may be carried out in a fixed bed. The vaporous fraction may in this case be passed through the bed in an up-flow or a down-flow direction. However, since the conversion to aromatic compounds may result in some coke deposition on the catalyst a gradual deactivation may take place in such a fixed bed. Therefore, it is preferred to conduct the conversion treatment in a setup of two or more fixed bed reactors in swing mode, or in a moving or fluidized bed reactor. In a fluidized bed, the catalyst may be continuously added and passed in a fluidized way to an exit whilst, being surrounded by vapors. The vapors initially comprise the vapors from the vaporous fraction, but they over time are converted to an aromatization product, stream consisting predominantly of aromatic compounds, small hydrocarbons, other gasses, coke and catalyst.

Hence, the aromatization product stream does not consist completely of aromatic compounds. It will contain gaseous compounds such as carbon dioxide, carbon monoxide, hydrogen, water, low molecular weight alkanes and also valuable by-products, such as olefins and oxygenates. It may be desirable to recover the olefins separately from the (tow molecular weight) aromatic compounds. Therefore, the conversion product is preferably subjected to fractionation, yielding aromatic compounds as separate fraction or fractions, optionally one or more olefin fractions, and a residue. To that end, the vaporous fraction can be passed to a cooling system e.g. a heat exchanger such as a condenser, to yielding a liquid stream and a vaporous stream.

The vaporous stream is likely to contain significant amounts of BTX due to the known relative high vapour pressure of compounds such as benzene. A suitable method for recovering the aromatic compounds from the fluid stream is constituted by a method wherein the conversion product is passed through an extraction column wherein light (i.e. low molecular weight) aromatics, being mainly BTX, are extracted from fluid stream to yield a BTX enriched liquid stream and a BTX impoverished fluid stream.

In one embodiment, a method of the present invention may also comprise recovering aromatic compounds from a vaporous stream that comprises the aromatic compounds such as the conversion, product, which method comprises contacting the vaporous stream with a liquid hydrocarbon to obtain a hydrocarbon phase containing aromatic compounds, and an oxygen-containing compound phase, and separating the hydrocarbon phase from the oxygen-containing compound phase. An oxygen containing compound phase can only be present if the plastic contains oxygen atoms and/or water is present within the materials. The aromatic compounds can be suitably recovered from the hydrocarbon phase via any known method, including distillation or fractionation. The liquid hydrocarbon can be aliphatic, cycloaliphatic, aromatic, fatty acid ester or a combination thereof. If aromatic hydrocarbons are used as liquid hydrocarbon it has the advantage that no extraneous products need to be used in the process. The aromatic hydrocarbons that are used for this purpose may be the product from the catalytic pyrolysis treatment step a). In other words, a fraction of the aromatic compounds that has been separated from the conversion product can be used to extract further aromatic compounds from the conversion product.

A further embodiment of the invention relates to a process for the preparation of aromatic compounds from a feed stream containing plastics, the process comprising a) subjecting a feed stream containing plastics or mixtures of plastics to a process as disclosed herein above to afford a conversion product comprising aromatic compounds; b) recovering the aromatic compounds from said conversion product; c) separating a higher molecular weight fraction comprising polyaromatic hydrocarbons (PAH) from a lower molecular weight fraction comprising benzene, toluene and xylem (BTX) by distillation;

d) optionally reducing said higher molecular weight fraction to obtain a reduced fraction comprising polycyclic aliphatics (PCA); and e) subjecting the higher molecular weight fraction obtained in step c), the reduced fraction obtained in step d), or a mixture thereof, to a process to obtain lower molecular weight aromatics (BTX).

Typically, step a) comprises pyrolysis of the plastic feed at high temperature in the range of 700 to 950° C., preferably in the range of 750 to 850° C., using a cheap cracking catalyst, followed by subsequently subjecting the vapors thus obtained to an ex situ catalytic aromatization step. In one embodiment, step a) comprises adding at least one further reactant to the feed stream, the reactant being selected from the group consisting of olefins, alcohols, aldehydes, ketones, acids and combinations thereof. For example, the further reactant comprises 1 to 6 carbon atoms, preferably wherein the further reactant is selected from the group consisting of ethene, propene, butene, isobutene, pentenes, hexenes, methanol, ethanol, propanol, isopropanol, hexanol, formaldehyde, acetaldehyde, acetone, methyl ethyl ketone, formic acid and acetic acid.

In one embodiment, step d) comprises catalytic hydrogenation, preferably using a catalyst selected from the group consisting of Ru/C, Ni/C, Pd/C, Pt/C, $MoS_2$, $WS_2$, Co—Mo—S/$Al_2O_3$, Ni—Mo—S/$Al_2O_3$, Ni—W—S/$Al_2O_3$, Co—Mo/$Al_2O_3$ or homogeneous catalysts such as the Wilkinson catalyst and the Crabtree catalyst. Said catalytic hydrogenation is suitably performed without the addition of a solvent.

Step e) advantageously comprises mixing the higher molecular weight fraction obtained in step c) or the reduced fraction obtained in step d) with a plastic feedstream, and subjecting the resulting mixture to pyrolysis or vaporization.

FIG. 1 provides the schematic diagram of the main steps of an ex situ thereto-catalytic pyrolysis process according to the invention.

A feed stream 45 comprising plastic enters the pyrolysis reactor 10 wherein it is subjected to a pyrolysis treatment at high temperatures ($T_{pyr}$ between 600-1000° C.) to yield pyrolysis vapours 61 comprising hydrocarbons, other gaseous components such as carbon dioxide, carbon monoxide and hydrogen, as well as ash, inorganic matter and coke. The pyrolysis vapours 61 is separated from the coke fraction in separation system 11, that may include a heat transfer medium in, to yield a vaporous fraction 62 comprising hydrocarbons, water and other gaseous components. The vaporous fraction 62 is actively cooled in a cooling system 12 to a temperature below $T_{pyr}$, to yield a to obtain a vaporous phase fraction 63. The cooling system may consist of a heat exchanger. The vaporous phase 63 is fed into aromatization reactor 20 wherein it is contacted with a catalyst and subjected to a conversion treatment at $T_{arom}$ in the range of 450-700° C., which aromatization temperature is at least 50° C. lower than the pyrolysis temperature, to yield an aromatic conversion stream 64 comprising aromatic compounds, in particular the low molecular weight aromatics BTX.

Figure 2:
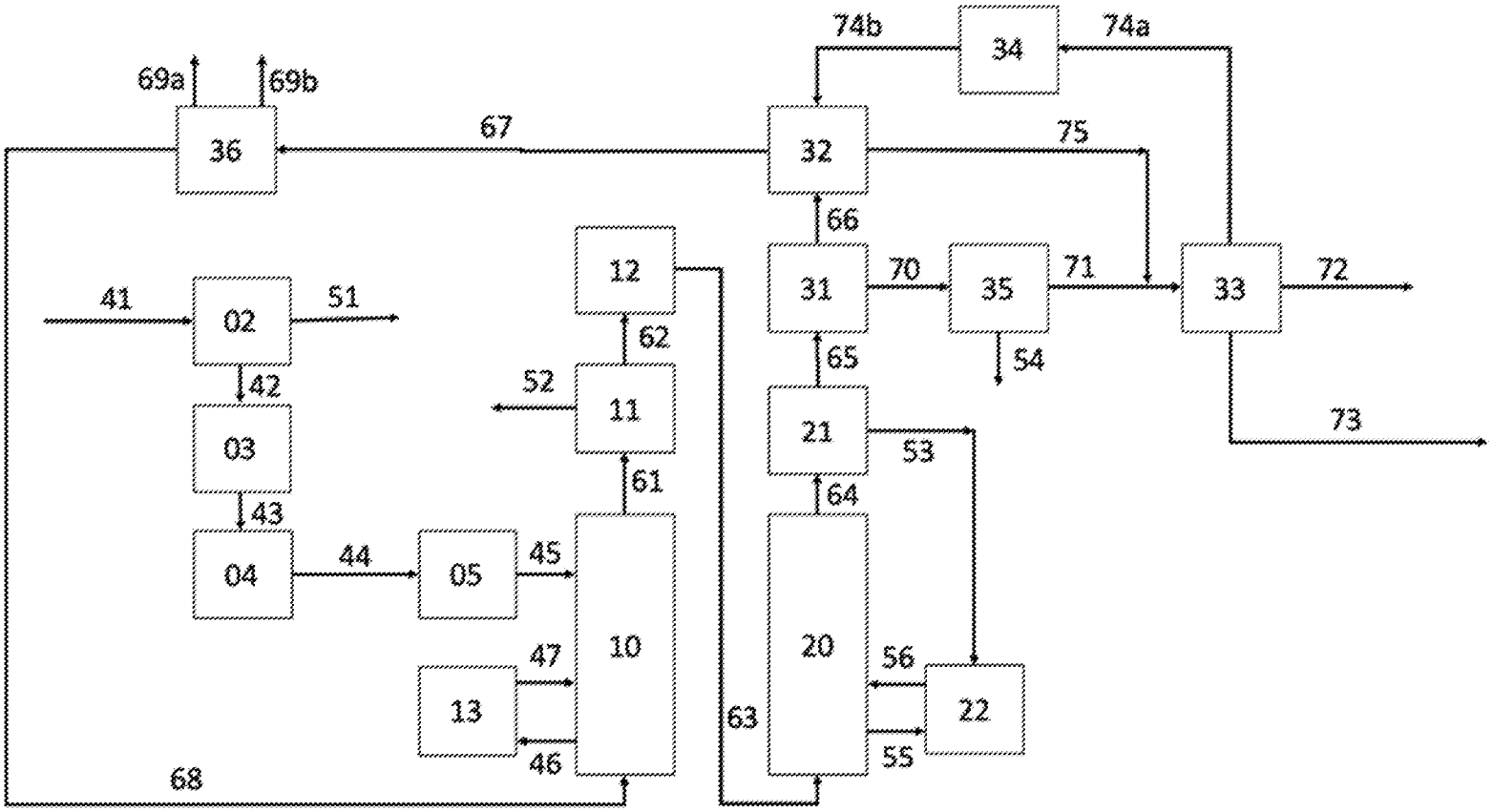

FIG. 2 provides the schematic diagram of a catalytic pyrolysis process according to one embodiment of the invention.

A feed stream 41 comprising plastic may optionally be subjected to a drying system 02 to reduce the reduce the moisture content. The moisture fraction 51 is removed providing a dried feed stream 42. The feed stream 41 or dried feed stream 42 may or may not be subjected to a shredding and/or grinding system 03 providing a shredded feed stream 43, The feed stream 41, dried feed stream 42 or shredded feed stream 43 may or may not be subjected to material shaping system 04, like shredding, grinding, pelletizing, sifting, and other suitable methods providing a shaped feed stream 44. The feed stream 41, dried feed stream 42, shredded feed stream 43, or shaped feed stream 44 is subjected to a feed system 05. The feed system may consist of a feeding screw, a cooled feeding screw, several feeding screws with or without cooling, an extruder, or any feed system suitable to process feed stream 41, dried feed stream 42, shredded feed stream 43, or shaped feed stream 44, The feed stream 45 enters the pyrolysis reactor 10 wherein it is subjected to a fast (typically up to 2 minutes) pyrolysis treatment at high temperatures ($T_{pyr}$ between 600-1000° C.) to yield pyrolysis vapours 61 comprising hydrocarbons (primarily low molecular weight alkanes/alkenes), other gaseous components such as carbon dioxide, carbon monoxide and hydrogen, as well as ash, inorganic matter and coke. The pyrolysis vapours 61 are separated from the coke fraction in separation system 11, that may include a heat transfer medium in, to yield a vaporous fraction 62 comprising hydrocarbons, water and other gaseous components. The solid fraction 52 may be removed, cooled and stored. The solid-gas separation system 11 may consist of one or more cyclones, a filter, or a combination thereof. The vaporous fraction 62 is actively cooled in an optional cooling system 12 to a temperature below $T_{pyr}$, to yield a to obtain a vaporous phase fraction 63, The cooling system may consist of a heat exchanger. The heat transfer medium may be air, steam, or a liquid.

In some embodiments, the reactor 10 is a fluid bed or circulating fluid bed, or moving bed, or comparable reactor type using some kind of medium in a bed. Optionally, stream 46 consists of coked bed material and coke particles. Optionally, stream 47 consists of fresh, de-coked or regenerated bed material. In some embodiments, stream 46 is oxygenated in system 13 to yield de-coked and regenerated bed material. System 13 may produce heat that can be utilized.

The vaporous phase 63 is fed into aromatization reactor 20 wherein it is contacted with a catalyst and subjected to a conversion treatment at $T_{arom}$ in the range of 450-700° C., which aromatization temperature is at least 50° C. lower than the pyrolysis temperature, to yield an aromatic conversion stream 64 comprising low molecular weight monocyclic aromatic compounds.

The aromatic conversion stream 64 leaving the conversion treatment reactor 20 can be used as such. Alternatively, aromatic compounds can be recovered from the conversion stream, for example using another solid-gas separation system 21, condenser 31, one or more scrubbers 32, and a separation system 33.

With reference to FIG. 2, aromatic conversion stream 64 consisting mostly of aromatic compounds, small hydrocarbons, other gasses, coke and catalyst product 64 can be subjected to a separation step 21. Non-vaporous stream 53, consisting of catalyst and other solids, is separated from the vaporous aromatic conversion stream 64 in separator 21. Stream 53 may then be passed to a regenerator 22 where it is suitably subjected to contact with an oxygen-containing gas to remove any coke that is deposited on the catalyst. The catalyst that is thus regenerated may, typically continuously, be recycled as stream 56 to the conversion treatment reactor 20. In some embodiments, catalyst is continuously removed from reactor 20 as stream 55 without the need for a separator. The separation of the vaporous fraction from the non-vaporous coke fraction in separation system 21 may be carried out in any known method to separate a vapor from a solid and/or liquid.

The vaporous aromatic conversion product 65 does not consist solely of aromatic compounds. It will contain gaseous compounds such as carbon dioxide, carbon monoxide, hydrogen, water, low molecular weight alkanes and also valuable by-products, such as olefins. It is sometimes desired to recover the olefins separately from the aromatic compounds. Therefore, the aromatic conversion product 65 may be subjected to fractionation, yielding low molecular weight monocycle aromatic compounds as separate fraction or fractions, optionally one or more olefin fractions, and a residue. Therefore, the vaporous fraction 65 is subsequently passed to a cooling system 31, yielding a liquid stream 70 and a fluid stream 66. Cooling system 31 may consist of a heat exchanger such as a condenser.

The liquid stream 70 is led to an oil-water separator 35 to separate, if water is present in the liquid stream, the organic liquids 71 from the aqueous layer 54. Such an oil water separator may consist for example of a decanter, hydro cyclone, or centrifugal liquid-liquid separator. Oxygen-containing compounds, including water that may be formed during the process, may separate from the mixture of conversion product and liquid hydrocarbon. In this way the aromatic hydrocarbons are recovered together with the liquid hydrocarbon. After separation of the liquid hydrocarbon phase that contains the low MW aromatic compounds from the phase that comprises oxygen-containing compounds, including water, the liquid hydrocarbon stream 71 is suitably subjected to fractionation (distillation) in section 33 to obtain the low molecular weight monocycle aromatic compounds.

Distillation system 33 yields top fraction 72, consisting of benzene, toluene, xylenes and other light aromatics and hydrocarbons. In some embodiments, distillation system 33 is equipped as fractional distillation, yielding benzene, toluene and xylenes as separate fractions. It is feasible to recover the various low molecular weight monocyclic aromatic compounds separately. Alternatively, it is feasible to recover all aromatic compounds in one fraction. The desired level of fractionation can be adopted in accordance with the needs and uses of the aromatic compounds.

The BTX lean bottom fraction 73 consists mainly of heavier aromatic compounds and substituted polyaromatic hydrocarbons. Product stream 73 may be used as a fuel or used for further downstream processing. A part of the bottom stream from 33 may also be used as recycle stream to increase BTX yields or as scrubbing liquid. In order to do so, it is separated as stream 74*a* and passed to heat exchanger 34 where the stream is cooled in order to be more effective in the extraction system 32.

Due to the known relative high vapor pressure of compounds such as benzene, fluid stream 66 produced in cooling system 31 is likely to contain significant amounts of BTX. A suitable method for recovering the aromatic compounds from fluid stream 66 is constituted by a method wherein the conversion product is passed through an extraction column. For example, a cooled liquid hydrocarbon 74*b* is sprayed onto the product stream 66 in extraction system 32 thereby cooling the conversion product and providing a solvent for the aromatic compounds. In extraction system 32, the low molecular weight aromatics, being mainly BTX, are extracted from fluid stream 66 to yield a BTX-enriched liquid stream 75 and a BTX-impoverished fluid stream 67. The BTX-enriched liquid stream 75 may be combined with liquid hydrocarbon stream 71 and led into distillation system 33.

Stream 67 may be passed to a fluid treatment section 36. In some embodiments, one or more additional gas-liquid extraction systems relay be present between system 32 and system 36 in order to retrieve more aromatics, water-soluble compounds, or other compounds. The additional gas-liquid extraction systems may be equipped with dedicated strippers.

A method of the invention may also include the recycling of gasses by feeding them into the pyrolysis reactor 10. The gasses obtained may be used to aid the feeding of the plastic into the reactor, as a carrier gas for a fluidized bed, or for other purposes where process gas can be used. The gasses formed may also be used to increase the liquid yield in the over-all process. In fluid treatment section 36, one or more common treatments of the fluid stream 67 may be applied, including fractionation to yield light olefins, splitting the stream in a gas recycle stream 68 and a product gas stream 69*a*, preheating of the recycle gas, etcetera.

Preferably, the fluid treatment section 36 also yields an olefin fraction 69*b*. The residue may be combusted to yield energy for the heating of the various feed streams and intermediate products. At least part of the one or more olefin fractions may be recycled with stream 68 to the conversion treatment. It is also possible to recycle at least part of the one or more olefins fractions to the pyrolysis treatment. Hence, at least part of the olefins fraction is suitably recycled to the conversion treatment, to the pyrolysis treatment or to both.

Another preferred method for increasing the yield of low molecular weight aromatic compounds is constituted by the addition of extra reactants to reactor 10 or reactor 20. Such extra reactants can suitably be selected from the groups consisting of olefins, alcohols, aldehydes, ketones, acids and combinations thereof. The extra reactants suitably have an effective hydrogen index (EHI) that is larger than the primary feed. Examples of suitable extra reactants include hydrogen, butane, isobutene, pentenes and hexenes, methanol, ethanol, propanol or isopropanol and hexanol, formaldehyde and acetaldehyde, acetone, methyl ethyl ketone, formic acid, acetic acid, polycyclic aliphatics, and partly reduced polyaromatics.

The aromatic compounds that are recovered as products of the present process may be used for conventional applications. These include application as fuels (like gasoline, diesel) but also as precursor for polymers and chemical intermediates.

The polyaromatic hydrocarbon fraction 73, obtained after the distillation of BTX, can subsequently be (re)-utilized (recycled) in the pyrolysis process, thereby affording a mixture of BTX and higher aromatics (see WO 2017/222380).

For example, a method of the invention comprises separating a high MW fraction 73 comprising polyaromatic hydrocarbons (PAH) from a low MW fraction 72 comprising benzene, toluene and xylene (BTX) by distillation, reducing at least part of said high MW fraction to obtain a reduced fraction comprising polycyclic aliphatics (PCA); and subjecting the high MW fraction obtained, the reduced fraction, or a mixture thereof, to a process to obtain low MW aromatics (BTX).

In one embodiment, the above described high molecular weight fractions (partially or fully reduced or not) are co-feeded with, a plastic or mixtures thereof, thereby resulting in significant higher yields of BTX. The BTX can easily be distilled and the remaining higher aromatic fraction can again be utilized in the pyrolysis or, alternatively, first reduced to an aliphatic/aromatic fraction and re-utilized in the pyrolysis step. Repeating the above-described procedure will result in high conversions of plastics towards BTX.

As used herein, the singular forms "a", "an" and "the" are intended to include the plural forms as well, unless the context clearly indicates otherwise. The term "and/or" includes any and all combinations of one or more of the associated listed items. It will be understood that the terms "comprises" and/or "comprising" specify the presence of stated features but do not preclude the presence or addition of one or more other features.

LEGEND TO THE FIGURES

FIG. 1 provides a schematic diagram of a catalytic pyrolysis process according to the invention.

FIG. 2 provides a schematic diagram of a catalytic pyrolysis process according to one embodiment of the invention.

Figure 3:
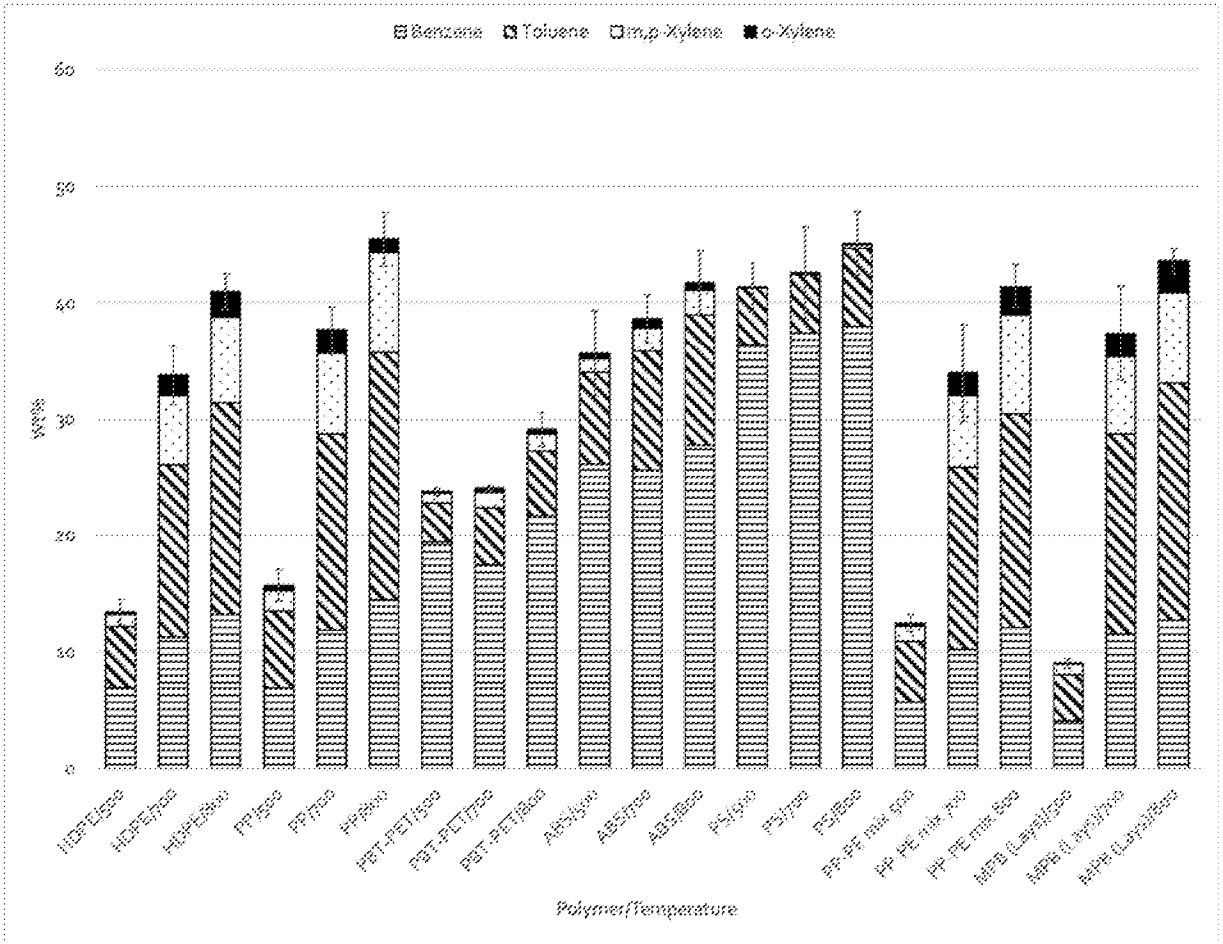

FIG. 3 displays the effect of the $T_{pyr}$ (500, 700 or 800° C.) for pyrolysis in the ex situ pyrolysis of the plastics high density polyethylene (HDPE), polypropylene (PP), mixture of polybutylene terephthalate/polyethylene terephthalate (PBT-PET), Acrylonitrile-butadiene-styrene (ABS), polystyrene (PS), polyethylene-polypropylene mixture (PP-PE mix), multi-layered plastic bags (MPB).

Figure 4:
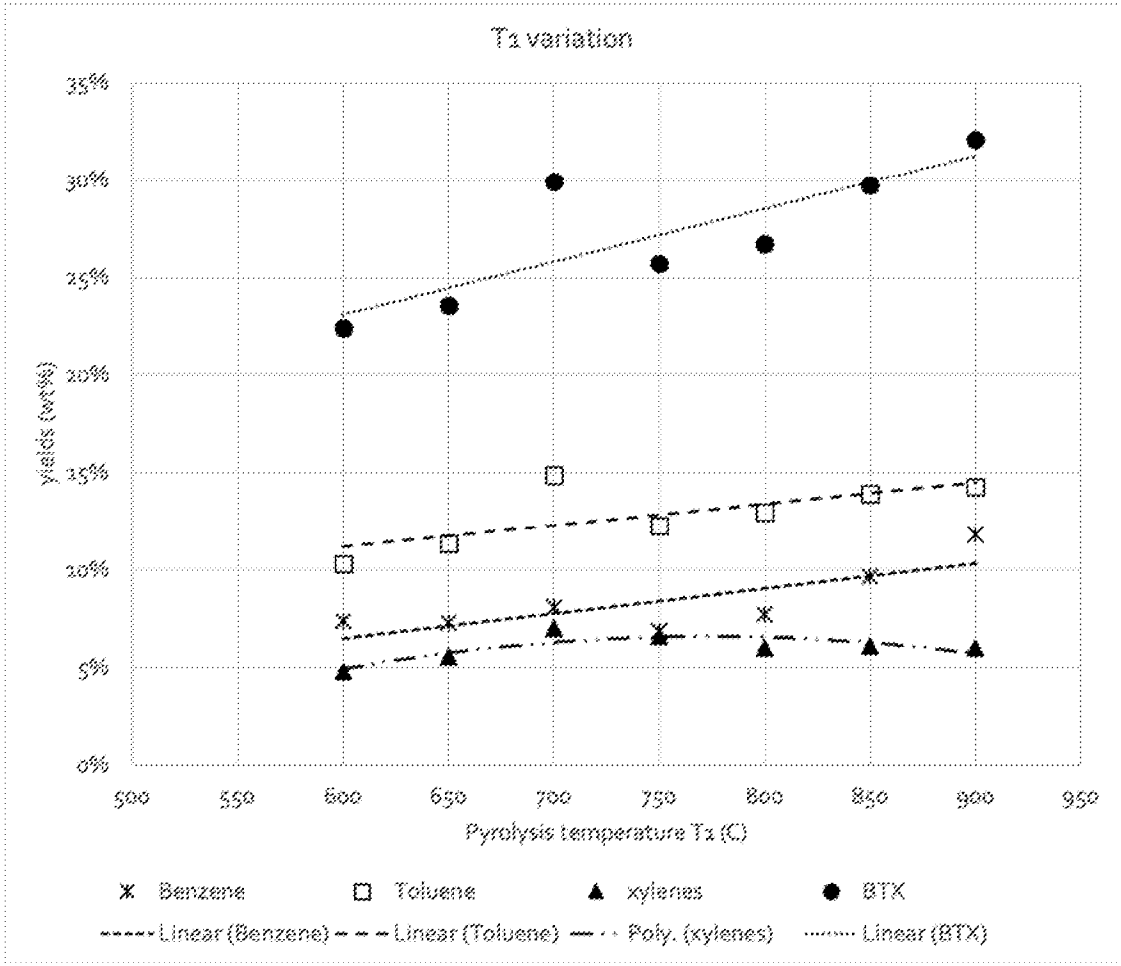

FIG. 4 displays the effect of the $T_{pyr}$ (600, 650, 700, 750, 800, 850 or 900° C.) for pyrolysis in the ex situ pyrolysis of the plastic polypropylene, whereby $T_{arom}$ is constant at 550° C.

Figure 5:
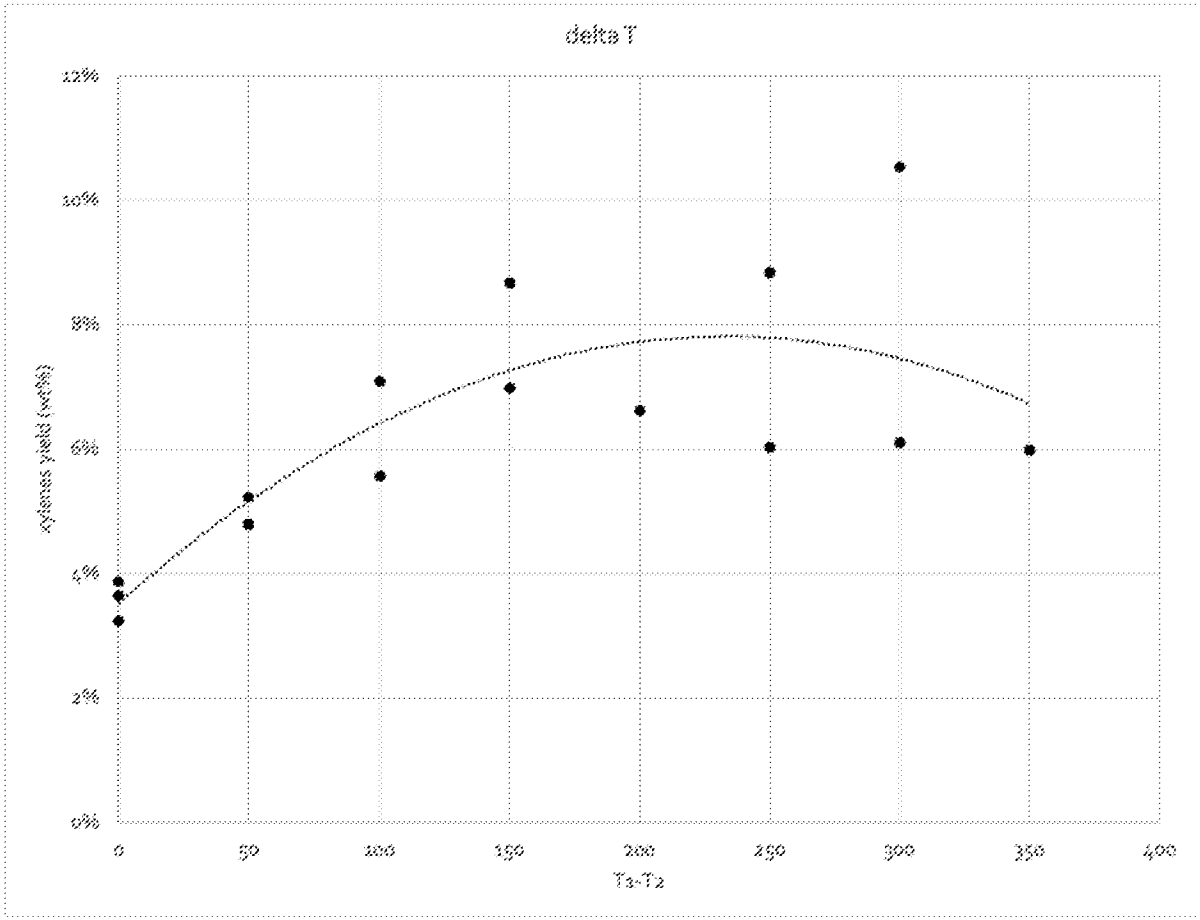

FIG. 5 displays the effect of the difference between $T_{pyr}$ (600, 650, 700, 750, 800, 850 or 900° C.) and $T_{arom}$ (450, 500, 550, 600, 650, 700° C.) on the xylenes yield.

EXPERIMENTAL SECTION

Materials and Methods

The experiments were performed on a Tandem μ-Reactor from Frontier Lab (Rx-3050TR) equipped with a single shot sampler (PY1-1040). The temperatures of both reactors and interfaces were controlled separately, allowing different reaction conditions for the pyrolysis (first reactor) and aromatization unit (second reactor). A carrier gas inlet was connected on the top of the first reactor, providing carrier gas flow through the reactors into the GC-MS. The entire system was attached by a docking station on top of the GC-MS and connected by an injection needle through a rubber septum.

Before experiments, approximately 80 mg of a H-ZSM-5 (23) catalyst (size 212-425 μM) was put in a quartz liner inside the second reactor. Thereafter, the system was pressurized to 150 kPa with an inert carrier gas (helium) to check for leakage. After the leak check, the pressure was set back to 50 kPa using a helium flow rate of 50 mL/min and the system was heated to the desired $T_{pyr}$ and $T_{arom}$.

In experiment A: reactor 1 ($T_{pyr}$): 500° C., 700° C. or 800° C., reactor 2 ($T_{arom}$); 550° C. and for both interfaces: 300° C.

In experiment B: reactor 1 ($T_{pyr}$): 600, 650, 700, 750, 800, 850 or 900° C., reactor 2 ($T_{arom}$): 550° C. and for both interfaces: 300° C.

In experiment C: reactor 1 ($T_{pyr}$): 600, 650, 700, 750, 800, 850 or 900° C. reactor 2 ($T_{arom}$): 450, 500, 550, 600, 650, 700° C. and for both interfaces: 300° C.

The residence time in each of the reactors was as follows: reactor 1 is estimated to be less than 3 seconds and reactor 2 is estimated to be 0.09 seconds.

A thin stainless steel cup was filled with a feed stream comprising different types of plastic(s) and attached to the sample injector, which hangs slightly above the first reactor. The system was closed and flushed for 3 min with helium gas. After flushing, the cup was dropped into the first reactor to start the pyrolysis reaction. The vapour products travel through the ZSM-5 (23) catalyst bed before entering the GC-MS.

The total yield of BTX (as well as the contribution of individual compounds benzene, toluene, m,p-xylene and o-xylene) obtained in experiment A is presented in FIG. 3 as the average of duplicate measurements and expressed in wt % based on the organic fraction present in the plastics. It clearly shows that, the yield of BTX significantly increases by increasing the temperature for pyrolysis from the conventional 500° C. to higher values such as 700 or 800° C.

The total yield of BTX (as well as the contribution of individual compounds benzene, toluene, and m,p,o-xylene) obtained in experiment B is presented in FIG. 4 and is expressed in wt % based on the organic fraction present in the plastics. It clearly shows that the yield of BTX, benzene and toluene significantly increases by increasing the temperature for pyrolysis from the conventional 600° C. to higher values such as 900° C. It also shows that the yield of xylenes initially increases increasing the temperature for pyrolysis from 600° C. to 700° C., but decreases increasing the temperature for pyrolysis above 800° C.

FIG. 4 shows that the yields of BTX, benzene, toluene, and xylenes significantly increase as $T_{pyr}$ increases, while keeping $T_{arom}$ constant at 550° C. Moreover, it indicates that, for xylenes, the $T_{pyr}$ should not be above 800° C.

The total yield of m,p,o-xylene (xylenes) obtained in experiment C is presented in FIG. 5 and is expressed in wt % based on the organic fraction present in the plastics. It clearly shows that the yield of xylenes increases by increasing the temperature difference between $T_{pyr}$ and $T_{arom}$ from zero to 150° C.

FIG. 5 depicts the xylenes yields from polypropylene catalytic pyrolysis, as a function of T1 ($T_{pyr}$) minus T2 ($T_{arom}$), with T1 in the range of 600 to 900° C. and T2 in the range of 450 to 700° C. The data shows that a $\Delta T_{pyr}T_{arom}$, of at least 50° C. results in a significant increase in the xylene yield. A further increase in $\Delta T_{pyr}T_{arom}$ up to 150° C. results in even higher xylenes yields, after which a flattening of the curve is observed.

The invention claimed is:

1. A two-step thermo-catalytic pyrolysis process for the preparation of low molecular weight monocyclic aromatic compounds from a feed stream comprising plastic, comprising the steps of:

a) subjecting a feed stream comprising a plastic to a pyrolysis treatment at a pyrolysis temperature ($T_{pyr}$) in the range of 600-1000° C. to produce pyrolysis vapors;

b) optionally actively cooling the pyrolysis vapors to a temperature that is below the pyrolysis temperature; and c) contacting the pyrolysis vapors with an aromatization catalyst at an aromatization temperature ($T_{arom}$) in the range of 450-700° C., which aromatization temperature is at least 50° C. lower than the pyrolysis temperature, in a catalytic conversion step to yield a conversion product comprising low molecular weight aromatic compounds; and d) optionally recovering the low molecular weight monocyclic aromatic compounds from the conversion product.

2. Process according to claim 1 wherein $T_{pyr}$ is in the range of 650 to 950° ° C.

3. Process according to claim 1, wherein step a) is performed in a pyrolysis reactor and a residence time in the pyrolysis reactor is less than 2 minutes.

4. Process according to claim 1, wherein $T_{arom}$ is in the range of 500 to 700° C.

5. Process according to claim 1, wherein $T_{arom}$ is at least 80° C. lower than $T_{pyr}$.

6. Process according to claim 1, wherein $T_{arom}$ is up to 200° C. lower than $T_{pyr}$.

7. Process according to claim 1, wherein $T_{pyr}$ is in the range of 650-850° C. and $T_{arom}$ is in the range of 500-600°C.

8. Process according to claim 1, wherein step c) is performed in an aromatization reactor and a residence time in the aromatization reactor is less than 2 minutes.

9. Process according to claim 1, wherein step d) comprises recovering benzene, toluene, and xylenes (BTX) from the conversion product.

10. Process according to claim 1, wherein the pyrolysis step a) and the catalytic conversion step c) take place in two different reactors.

11. Process according to claim 1, wherein the aromatization catalyst is selected from the group consisting of ZSM-5, ZSM-11, ZSM-35, ZSM-23, ferrierite, zeolite beta, zeolite Y, zeolite X, mordenite, zeolite A, IM-5, SSZ-20, SSZ-55, MCM-22, TNU-9, metal treated, exchanged or impregnated catalyst and combinations thereof.

12. Process according to claim 1, wherein the feed stream comprises synthetic or semi-synthetic polymers or mixtures thereof, including polyolefines, aromatic polymers, fibre enforced composite materials, multi-layered plastics, mixed plastics waste polyamides, and/or recycling refuses, or a liquid stream derived from the pyrolysis of any of the preceding materials.

13. Process according to claim 1, wherein the feed stream comprises or consists of one or more of polypropylene (PP), polyethylene (PE), polybutylene terephthalate (PBT) and polyethylene terephthalate (PET), acrylonitrile butadiene styrene (ABS), polystyrene (PS) and polyamide (PA).

14. Process according to claim 1, wherein step b) comprises cooling the pyrolysis vapors with the aid of a heat exchanger.

15. Process according to claim 1, wherein the pyrolysis treatment of step a) is performed in the presence of a cracking catalyst to yield pyrolysis vapors and a coke-laden cracking catalyst, followed by separating the pyrolysis vapors from the coke-laden cracking catalyst.

16. Process according to claim 15, wherein the cracking catalyst is selected from the group consisting of acidic or alkaline inorganic materials, and amorphous or crystalline silica-alumina-comprising materials.

17. Process according to claim 1 wherein $T_{pyr}$ is in the range of 700 to 850° ° C.

18. Process according to claim 1, wherein $T_{arom}$ is at least 100° C. lower than $T_{pyr}$.

19. Process according to claim 1, wherein $T_{arom}$ is up to 175° C. lower than $T_{pyr}$.

* * * * *